United States Patent [19]

Bigler

[11] 4,149,469

[45] Apr. 17, 1979

[54] LOG BRAKING AND STABILIZING SYSTEM FOR LOG FLUME RIDE

[75] Inventor: Alfred Bigler, Marietta, Ga.

[73] Assignee: Six Flags, Inc., Marietta, Ga.

[21] Appl. No.: 838,813

[22] Filed: Oct. 3, 1977

[51] Int. Cl.[2] ..... A63G 21/18; B66F 3/34 B66F/7/08

[52] U.S. Cl. ..... 104/73; 104/70; 104/249; 114/44; 254/10 C; 254/89 H; 254/93 HP; 405/3; 10/678; 10/917

[58] Field of Search ..... 104/53, 63, 104/69, 70, 71, 72, 73, 134, 164, 249, 250, 256; 188/62, 216; 254/10R, 10 B, 10 C, 89 H, 93 HP; 272/32; 92/34, 45, 140; 214/1 A, DIG. 10; 114/44, 45; 405/3, 4

[56] References Cited

U.S. PATENT DOCUMENTS

| | | | |
|---|---|---|---|
| 665,765 | 1/1901 | Thompson | 104/73 |
| 1,037,958 | 9/1912 | Miller | 188/62 |
| 3,114,332 | 12/1963 | Bacon et al. | 104/63 |
| 3,317,004 | 5/1967 | Harrison, Jr. | 254/10 C X |
| 3,404,635 | 10/1968 | Bacon et al. | 104/73 X |
| 3,730,366 | 5/1973 | Berends | 254/93 HP X |
| 3,828,688 | 8/1974 | Bradbury | 104/256 X |
| 3,830,161 | 8/1974 | Bacon | 104/70 |

FOREIGN PATENT DOCUMENTS

| | | | |
|---|---|---|---|
| 463571 | 5/1975 | U.S.S.R. | 104/256 |

*Primary Examiner*—Francis S. Husar
*Assistant Examiner*—Randolph A. Reese
*Attorney, Agent, or Firm*—Harris, Kern, Wallen & Tinsley

[57] ABSTRACT

A braking and stabilizing system for a boat in a water channel, including boat lifting apparatus in the water channel engageable with the bottom of the boat, and including inflatable bags connected to the boat lifting apparatus for moving same upwardly to lift the boat while stabilizing same.

3 Claims, 7 Drawing Figures

LOG BRAKING AND STABILIZING SYSTEM FOR LOG FLUME RIDE

BACKGROUND OF INVENTION

The present invention relates in general to a braking and stabilizing system for a boat in a water channel, especially a log-like boat used in a log flume ride. More particularly, the invention relates to a system which lifts the boat and stabilizes it for embarkation and debarkation of passengers relative to a passenger loading and unloading dock adjacent the water channel.

The following prior art, all U.S. patents, is relevant:

| Patent No. | Patentee |
|---|---|
| 665,765 | Thompson |
| 749,691 | Jackman |
| 783,425 | Folks |
| 3,114,332 | Bacon et al |

The Thompson patent is probably the most pertinent of the foregoing, but, as will become apparent, discloses a different structure from the present invention operating in a different manner.

SUMMARY AND OBJECTS OF INVENTION

The primary object of the present invention is to provide a braking and stabilizing system, for a log-like boat for a log flume ride, or the like, which includes pneumatic means for lifting and stabilizing the boat during passenger embarkation and debarkation.

More particularly, an important object of the invention is to provide a braking and stabilizing system which includes, and the invention may be summarized as including, boat lifting means in a water channel for the boat which is engageable with the bottom of the boat, and inflatable pneumatic means connected to the boat lifting means for moving same upwardly to elevate the boat and, at the same time, stabilize it as passengers enter and leave.

Another object is to provide a base and two pairs of lifting arms interconnecting the base and the boat lifting means, the inflatable means being connected to one of the pairs of lifting arms. A related object is to provide a structure wherein the boat lifting means, the base and the pairs of lifting arms form a parallelogram linkage.

Another important object is to provide a pneumatic means which includes a second inflatable means connected to the boat lifting means for moving same downwardly to refloat the boat. Thus, the upward and downward motion of the boat lifting means is positive in nature, the upward movement being produced by the first inflatable means and the downward movement by the second, which is an important feature.

A major advantage of the foregoing construction is that since the boat lifting means is elevated and lowered by inflatable pneumatic devices, preferably of an elastomeric rubber-like material, there are no submerged or submersible parts to be corroded by the water, as opposed to a system involving pneumatic or hydraulic rams, for example. Consequently, the inflatable pneumatic devices of the invention can be expected to have a long trouble-free service life, which is an important feature.

The foregoing objects, advantages, features and results of the present invention, together with various other objects, advantages, features and results which will become apparent in the light of this disclosure, may be achieved with the exemplary embodiment of the invention illustrated in the accompanying drawings and described in detail hereinafter.

DESCRIPTION OF EXEMPLARY EMBODIMENT OF INVENTION

Figure 1:
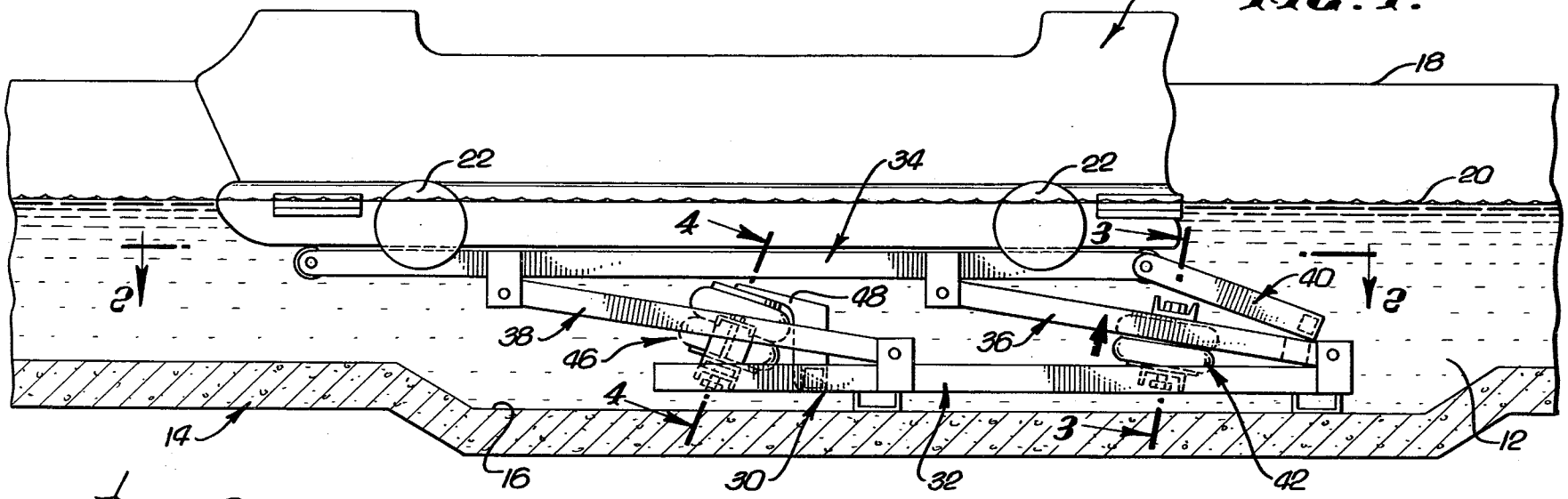
FIG. 1 is a side elevational view of a log-like boat partially elevated by a braking and stabilizing system of the invention located in the loading and unloading area of a flume channel shown in longitudinal section.
Figure 2:
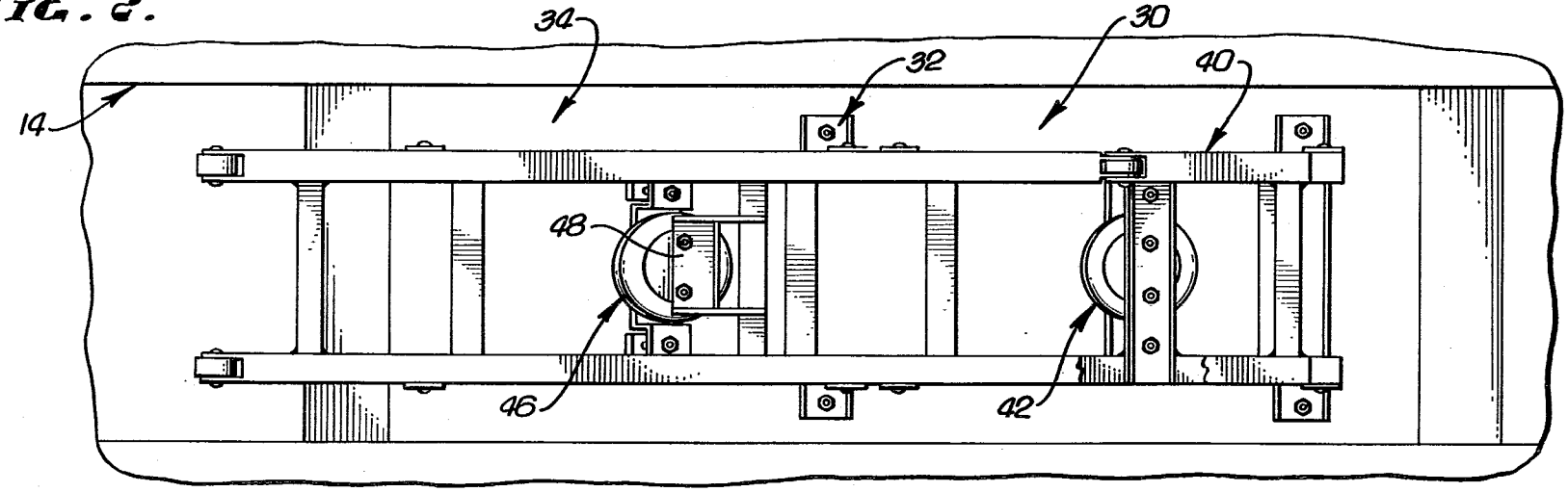
FIG. 2 is a plan view taken as indicated by the arrowed line 2—2 of FIG. 1.

Referring initially to FIG. 1 of the drawings, illustrated therein is a log-like boat 10 adapted to float on water 12 in a channel 14 forming part of a closed circuit or path for the boat, which path includes a flume, not shown. The channel 14 includes a deepened loading and unloading area 16 having a loading and unloading dock 18 thereadjacent. The water level in the portion of the channel 14 shown is designated by the numeral 20. The boat 10 may be equipped with wheels 22 on both sides designed to run on track-forming portions, not shown, of the closed boat path mentioned above.

Disposed in the loading and unloading area 16 of the channel 14 is a boat braking, lifting and stabilizing system 30 of the invention. The system 30 includes as one of its primary components a rectangular base 32 which is suitably anchored to the bottom of the loading and unloading area 16 of the channel 14.

A rectangular boat lifting, supporting and stabilizing frame 34 for the boat 10 is mounted on the base 32 by a pair of lifting arms 36 and another pair of lifting arms 38, the frame 34 being engageable with the bottom of the boat. The respective ends of the lifting arms 36 are pivotally connected to the base 32 and the frame 34, the same being true of the lifting arms 38. It will be noted that the base 32, the frame 34 and the lifting arms 36 and 38 form a parallelogram linkage which maintains the frame 34 horizontal as it is moved upwardly and downwardly in a manner to be described. An inclined ramp 40 at the upstream end of the system 30 is pivotally connected at one end to the upstream end of the frame 32, the lower end of the ramp resting on the lifting arms 36. This ramp guides the boat 10 upwardly onto the frame 34 in the event that the bottom of the boat is slightly below the top of the frame as the boat approaches.

Figure 3:
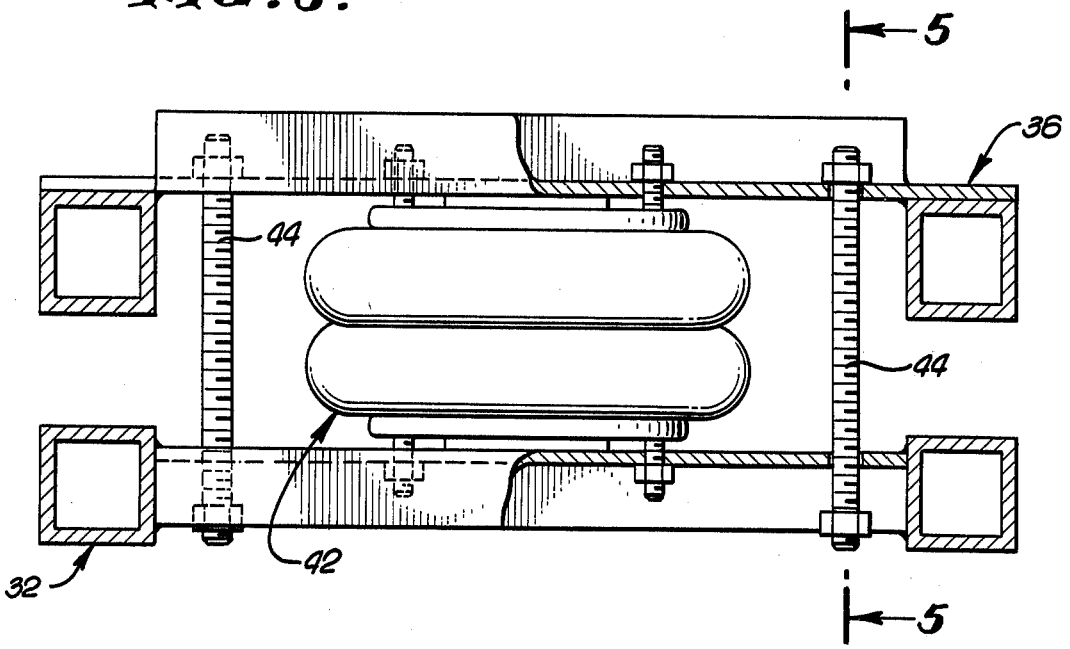
FIGS. 3 and 4 are sectional views respectively taken as indicated by the arrowed lines 3—3 and 4—4 of FIG. 1.
Figure 5:
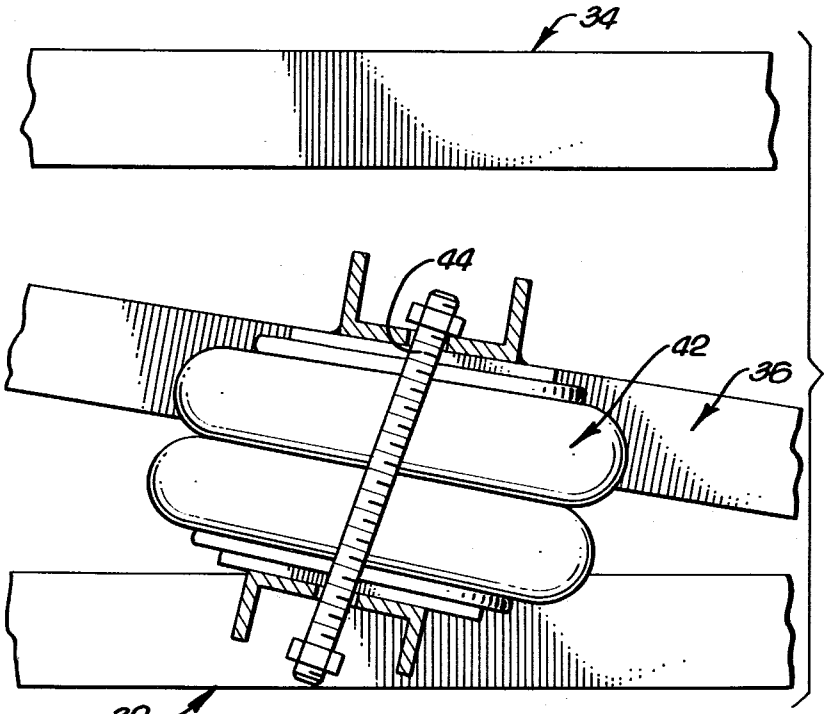
FIGS. 5 and 6 are sectional views respectively taken as indicated by the arrowed lines 5—5 and 6—6 of FIGS. 3 and 4.

As best shown in FIGS. 1, 3 and 5, interposed between the base 32 and the lifting arms 36 is a first inflatable pneumatic means 42, shown as comprising a stack of two air bags inflatable with compressed air. Any suitable control means, not shown, may be used to inflate the pneumatic means 42 when it is desired to lift the frame 34 and a boat 10 thereon, and to deflate the pneumatic means 42 when subsequent lowering of the frame 34 and the boat 10, to refloat the boat, is desired.

It will be apparent that inflating the pneumatic means 42 causes same to lift the arms 36 to, in turn, lift the frame 34, and the boat 10 thereon. As best shown in FIG. 3, rods 44 interconnecting the base 32 and the lifting arms 36 limit upward movement of the frame 34.

Figure 4:
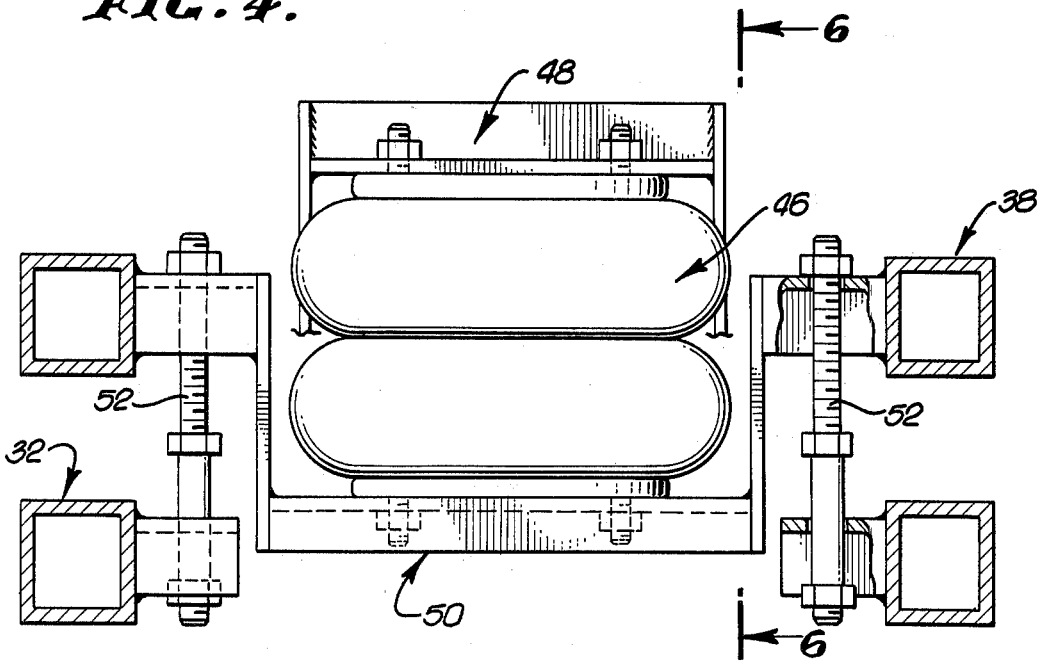
Figure 6:
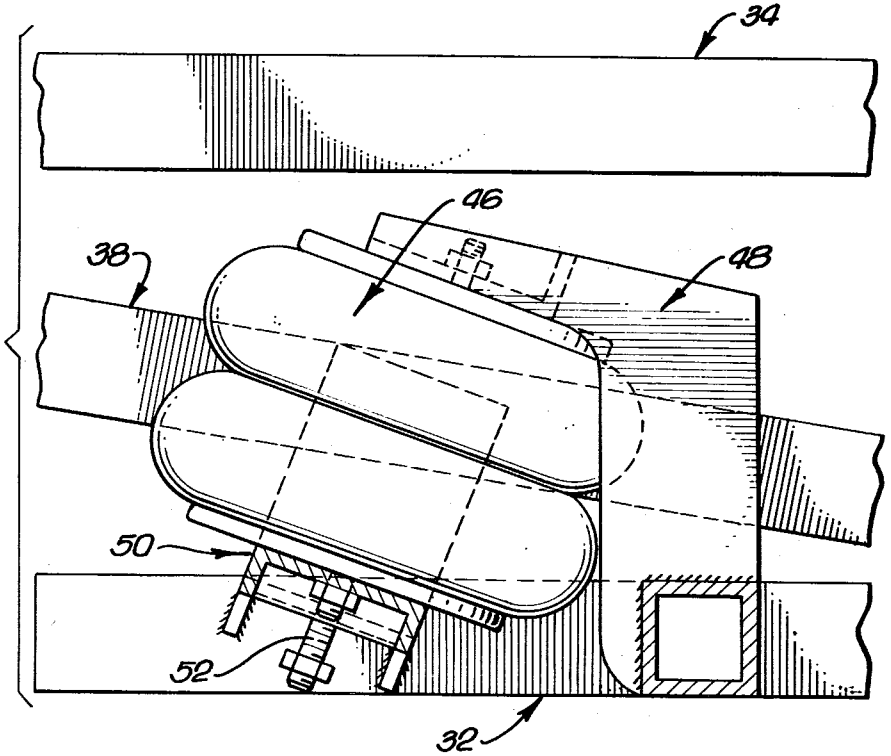

A second inflatable pneumatic means 46, FIGS. 1, 4 and 6, may be inflated with compressed air and subsequently deflated by any suitable control means, not shown. The pneumatic means 46 is disposed between an upward extension 48 of the base 32 and a downward extension 50 of the lifting arms 38. Thus, when the pneumatic means 42 is deflated, and the pneumatic means 46 is inflated, the pneumatic means 46 acts on the lifting arms 38 to pull the frame 34 downwardly to refloat the boat 10. Thus, positive movement of the frame 34 both upwardly and downwardly is achieved, upward movement being provided by the pneumatic means 42, which can be regarded as comprising "up" bags, and downward movement being provided by the pneumatic means 46, which can be considered as including "down" bags. Upward motion of the lifting arms 38 relative to the base 32 is limited by rods 52 interconnecting the base and the lifting arm 38, as best shown in FIG. 4.

Figure 7:
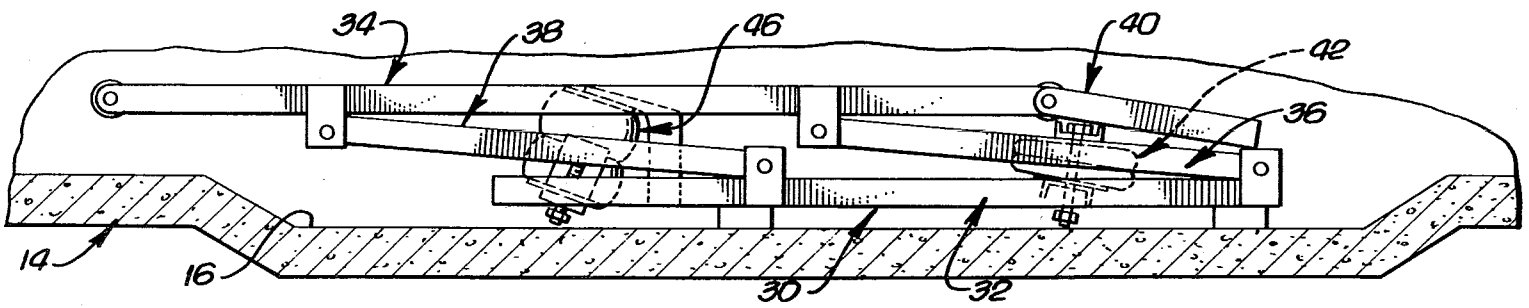
FIG. 7 is a fragmentary view similar to a portion of FIG. 1, but showing the braking and stabilizing system of the invention in its collapsed, lowered position.

Summarizing the operation of the boat braking, lifting and stabilizing system 30, as the boat reaches the system 30, its bow rides up the ramp 40 to guide the bottom of the boat onto the frame 34. As the boat 10 approaches the position shown in FIG. 1, the "up" pneumatic means 42 is energized to lift the frame 34 and the boat thereon, thereby braking the boat to a stop, and stabilizing it while passengers embark or debark. At this time, the "down" pneumatic means 46 is not energized. When it is subsequently desired to refloat the boat 10, the "up" pneumatic means 42 is de-energized and the "down" pneumatic means 46 is activated to retract the frame 34 downwardly to its lowermost position, as shown in FIG. 7. The boat 10 is then free to float with the current down the channel 14, i.e., toward the left as viewed in FIG. 1. Positive lifting of the frame 34 and boat 10 by the "up" pneumatic means, and positive lowering of the frame 34 and the boat 10 by the "down" pneumatic means 46, insures that the system 10 will operate efficiently and quickly, which is an important feature of the invention. As previously pointed out, the air bags forming the "up" pneumatic means 42 and the "down" pneumatic means 46 are not subject to corrosion by the water 12 so that a long service life without repairs can be anticipated.

Although an examplary embodiment of the invention has been disclosed for illustrative purposes, it will be understood that various changes, modifications and substitutions may be incorporated in such embodiment without departing from the invention as hereinafter claimed.

I claim as my invention:

1. In a braking and stabilizing system for a boat in a water channel, the combination of:

(a) boat lifting means in the water channel engageable with the bottom of the boat;

(b) first inflatable flexible bag means connected to said boat lifting means for positively moving same upwardly; and (c) second inflatable flexible bag means connected to said boat lifting means for positively moving same downwardly.

2. A system according to claim 1 including two pairs of lifting arms pivotally connected to said base and to said boat lifting means, said first inflatable flexible bag means being connected to one of said pairs of lifting arms and said second inflatable flexible bag means being connected to the other of said pairs of said lifting arms.

3. A system as set forth in claim 2 wherein said boat lifting means, said base and said pairs of lifting arms form a parallelogram linkage.

* * * * *